United States Patent [19]

Hogan

[11] Patent Number: 4,971,143

[45] Date of Patent: Nov. 20, 1990

[54] FAN STATOR ASSEMBLY FOR HEAT EXCHANGER

[75] Inventor: Mark R. Hogan, Manlius, N.Y.

[73] Assignee: Carrier Corporation, Syracuse, N.Y.

[21] Appl. No.: 354,885

[22] Filed: May 22, 1989

[51] Int. Cl.[5] ..... F28F 13/06

[52] U.S. Cl. ..... 165/122; 165/121; 415/211.2; 123/41.49; 62/428

[58] Field of Search ..... 165/121, 122; 62/426, 62/428; 415/211.2; 416/181.2, 207, 220; 123/41.49, 41.65

[56] References Cited

U.S. PATENT DOCUMENTS

| | | | |
|---|---|---|---|
| 2,032,811 | 3/1936 | Perkins et al. | 165/122 |
| 2,154,313 | 4/1939 | McMahan | 416/189 |
| 2,873,908 | 2/1959 | Powers | 415/211.2 |
| 4,358,245 | 11/1982 | Gray | 416/189 |
| 4,548,548 | 10/1985 | Gray, III | 416/189 |
| 4,569,631 | 2/1986 | Gray, III | 416/189 |

FOREIGN PATENT DOCUMENTS

| | | | |
|---|---|---|---|
| 58-69335 | 4/1983 | Japan | 165/122 |

*Primary Examiner*—Martin P. Schwadron
*Assistant Examiner*—Allen J. Flanigan
*Attorney, Agent, or Firm*—Wall & Roehrig

[57] ABSTRACT

A stator row is disposed between a propeller fan and a heat exchanger coil, such as the outdoor or condenser coil of a packaged terminal air conditioning unit. The stator row is situated against the heat exchanger coil on the fan facing side. The stator row has a frame that substantially matches the periphery of the coil, a ring disposed coaxially with the hub of the propeller fan, and a suitable number of radial stator vanes that extend from the ring to the frame.

9 Claims, 4 Drawing Sheets

FAN STATOR ASSEMBLY FOR HEAT EXCHANGER

BACKGROUND OF THE INVENTION

The present invention relates to air-moving fans, and is more particularly directed to a heat exchanger assembly in which a fan draws or forces air through a heat exchanger coil. The invention specifically concerns the employment of a stator row with a propeller fan which moves air through a heat exchanger coil.

In a specific embodiment described hereafter, a stator row is applied beneficially to a packaged terminal air conditioner (PTAC), and would also be appropriate for room air conditioners or other similar devices.

A packaged terminal air conditioner is a unit having an interior or indoor side connected to an exterior or outdoor side through a penetration in a wall of a building. These units are generally used both in summer as an air conditioner for cooling and in winter as a heat pump for heating. The PTAC generally uses the same motor and drive shaft to power a centrifugal fan on the interior side and a propeller fan on the exterior side.

It has long been a goal in the industry to increase the air moving efficiency of the fans. This yields a dual benefit of requiring less electrical power and also reducing the noise level due to the fans.

Although stators in general are well known, e.g., in various compressors, they have not been used widely in the heating, ventilation, and air conditioning (HVAC) field, and have never been applied in PTAC units.

One combination of propeller fan with a stator assembly has been previously described in Gray, U.S. Pat. No. 4,548,548 for use in an automotive environment. In that patent, the fan is intended to blow air through a heat exchanger, and a circular stator placed immediately after the fan to direct the exhaust axially. The intention there is to remove rotational components, and provide smoother air flow through the heat exchanger. The stator assembly of the Gray patent forms part of the spider or frame that suspends the fan and motor in front of the heat exchanger. The stator there was also specifically intended for use with a so-called banded fan where the fan blade tips are connected by a circumferential skirt. In the Gray patent, the stator is circular in cross-section because it is integral to the fan-motor system and because it is designed to accommodate the flow field dominated by the fan. This is good practice when either the effective face area of the fan is approximately equal to the face area of the coil, or the axis of the fan coincides with the geometric center of the coil face.

However, when the face area of the coil is significantly larger than the face area of the fan, and/or the axis of the fan is offset from the geometric center of the coil, the stator placement and geometry must account for diffusion in order to achieve maximum benefit. This is critical because it is quite difficult to diffuse or expand the airstream from the circular geometry and discharge area of the fan to the larger and/or offset rectangular geometry of the coil. Maximum diffusion is necessary to minimize the natural tendency towards non-uniform air flow across the face of the coil with the concomitant increase (relative to uniform flow) in air-side coil pressure loss and under-utilization of heat transfer surface.

To maximize diffusion in order to achieve favorable control of the above-mentioned effects, it is beneficial to place the stator against the coil and to configure its overall geometry to match the coil face area. This allows the centrifugal force due to swirl to facilitate the outward diffusion process and, consequently, maximize uniform flow across the face of the coil. If the stator were placed generally at the fan discharge (Gray patent), the swirl velocity component would be removed prior to the diffusion process and, hence, would be unavailable to achieve the requisite diffusion.

OBJECTS AND SUMMARY OF THE INVENTION

It is an object of this invention to recover a significant part of the rotational energy from the discharge of a propeller fan and convert it to useful form, such as increased pressure, while maximizing uniform air flow across the coil face and minimizing the angle between the coil fin pack and the incident air velocity.

It is a related object of this invention to reduce fan noise and fan shaft power requirements for a propeller fan that is used with a heat exchanger coil.

In accordance with an aspect of this invention, a finned condenser coil, or other heat exchanger coil, is combined with an axial-flow propeller fan, a shroud, and a stator row disposed substantially against the fan side of the coil. The heat exchanger coil has a flat face and a plurality of fins that define air passages between which air passes through the heat exchanger. These passages thus are generally perpendicular to this flat face. The axial flow propeller fan is positioned to face the heat exchanger flat face with its axis passing through the heat exchanger. However, in most cases, the fan axis is displaced to one side or the other from the center of the heat exchanger. The fan has a hub and a plurality of blades that radiate out from the hub, and is driven rotationally by an electric motor or the like. The blades have a pitch that is selected to impart a generally axially flow to the air when the fan rotates. However, the flow also has a swirl component, i.e., a component in the tangential or circumferential direction. A shroud is disposed over the fan and heat exchanger for guiding the air into the fan. The shroud also ensures that the air is forced through the heat exchanger and does not simply recirculate to the intake side of the fan. The stator row is mounted on the flat face of the heat exchanger and is substantially coextensive with it. The stator row has an outer frame that substantially matches the perimeter of the flat face, and a ring that is substantial coaxial with the fan. A plurality of radial stator vanes or blades extend from the ring to the frame and these vanes have their pitch complementary to that of the fan blades. The stator vanes turn the airstream until the air velocity is generally axial. This transforms the swirl kinetic energy into a more useful form of energy, by raising static pressure. This also minimizes the angle between the coil fins and the incident airstream, hence reducing coil airside pressure loss.

Positioning the stator against the coil, rather than placing it in the immediate vicinity of the fan discharge, takes advantage of swirl in aiding diffusion prior to transforming swirl into static pressure. Swirl centrifugates the airstream which promotes uniform flow over the face of the coil. Only after this diffusion is maximized is the stator introduced to eliminate swirl and transform it into static pressure. Since maximum diffusion occurs, the flow field is dominated by the presence and characteristic dimensions of the coil. Hence, the optimal stator is configured to assume the generally rectangular shape of the coil.

It should be understood that a propeller fan in the air flow circuit increases the fluid static pressure and kinetic energy. The air flow leaving the fan blades has a velocity vector $V_{AF}$ having both an axial component and a tangential component $V_{\theta O}$. If nothing is done to recover the energy in the tangential component, this energy is eventually dissipated as heat. That is, the swirl or tangential component represents work done on the fluid and then lost. If the tangential component $V_{\theta O}$ can be recovered efficiently, then the loss attributable to it is minimized. The change in this component $V_{\theta O}$ is recovered as an increase in static pressure. A stator row, which is a flat arrangement of stationary stator blades or vanes effectively reduces this component $V_{\theta O}$. That is, the air flow into the stator row has the flow velocity $V_{AF}$, while the air flow leaving the stator row has a velocity $V_S$, which includes a significantly smaller tangential component $V_{\theta 1}$. The difference between these components $V_{\theta O}$ and $V_{\theta 1}$, less some losses due to the presence of the stator vanes, represents a conversion to static pressure at the face of the heat exchanger. This conversion, in turn, represents an increase in static pressure. Since the stator row is now recovering what would otherwise be lost by converting kinetic energy into static pressure, less fluid work is required to generate the same static pressure as previously. Aiding this process is a reduction in the static pressure requirements of the system. This reduction results from a coil loss reduction as a consequence of the reduced angle between the fin channel and the incident airstream, and of the more uniform air flow across the coil. Consequently, for the same system, a lower static-pressure-rise fan, in conjunction with the stator row, can be utilized in place of a high-pressure-rise fan without a stator. This results in a much quieter operation and with significantly less power required to deliver a given air flow rate.

In tests conducted in connection with the embodiment described below, a 40% reduction in shaft power and a 3.6 dBA noise reduction have been realized owing to the stator row down stream of the propeller fan on the outdoor or condenser side of a PTAC. This was achieved without reduction in actual air flow rate.

The above and many other objects, features and advantages of this invention will be more fully appreciated from the ensuing description of a preferred embodiment of the invention, which is to be read in connection with the accompanying drawing.

DETAILED DESCRIPTION OF THE PREFERRED EMBODIMENT

Figure 1:
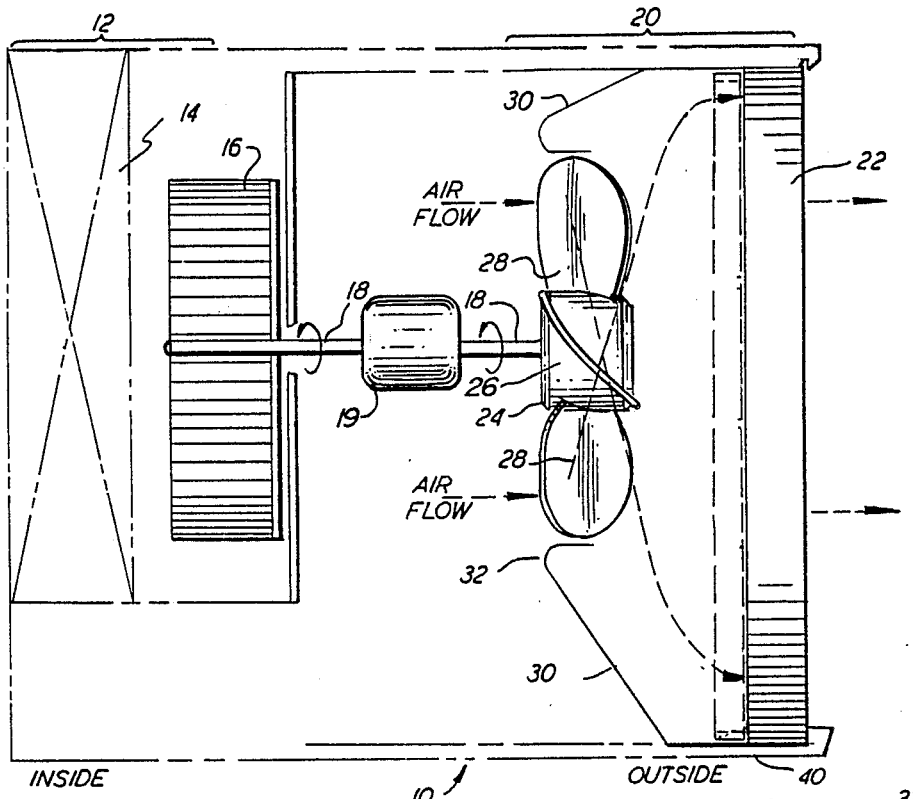
FIG. 1 is a schematic sectional plan view of a packaged terminal air conditioner unit (PTAC) which incorporates the heat exchanger, fan, and stator assembly according to one embodiment of this invention.

With reference to the Drawing, and initially to FIG. 1 thereof, a packaged terminal air conditioner (PTAC) unit 10 has an indoor portion 12 which includes an evaporator coil 14 and a centrifugal fan 16 mounted on a drive shaft 18 driven by a motor 19 of conventional type. An outdoor portion 20 includes a condenser coil 22 and a propeller fan 24 driven by the shaft 18. The fan 24 has a hub 26 mounted on the shaft 18 and a number of blades 28 which radiate from the hub 26.

A shroud 30 extends over the coil 22 from a circular opening 32 at the tips of the fan blades 28. The shroud 30 guides the air into the fan 24 and thence through the heat exchanger coil 22. The shroud also serves to prevent recirculation or looping of air through the fan.

Figure 1A:
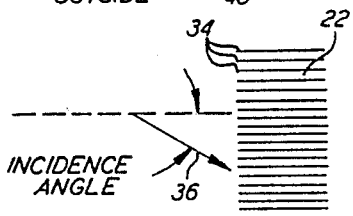
FIG. 1A a is a supplemental view of a portion of the unit of FIG. 1, for explaining the effect of the incidence angle of air flow onto fins of the heat exchanger.

As shown in FIG. 1*a*, the air flow from the fan 24 is not axial, but has its velocity vector 36 angled so as to strike fins 34 of the heat exchanger at a significant incidence angle. Consequently, at the surface of the heat exchanger, the air flow must bend to the axial direction to pass through the passages between the fins 34. This large turn increases the pressure losses through the heat exchanger.

Figure 2:
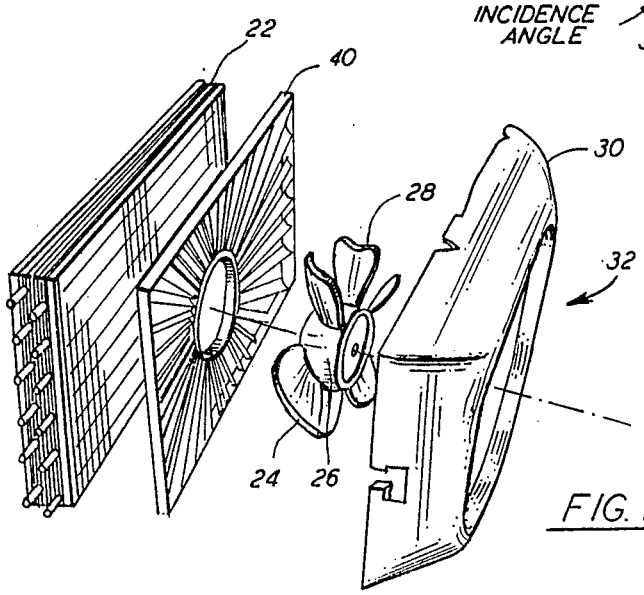
FIG. 2 is an exploded perspective view of the outdoor or condenser portion of the PTAC.
Figure 3:
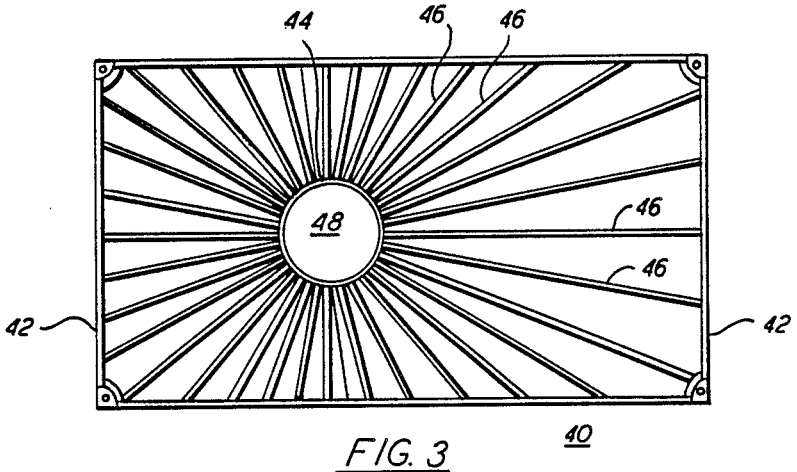
FIG. 3 is a front elevational view of a stator assembly according to this embodiment of the invention.
Figure 4:
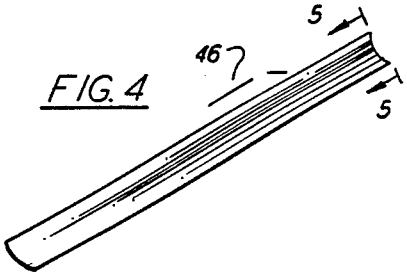
FIG. 4 shows a typical stator vane or blade of the stator assembly of FIG. 3.
Figure 5:
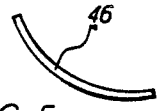
FIG. 5 is a cross section of the stator vane of FIG. 4, taken at lines 5–5 thereof.

In order to correct for swirl, a stator row 40 is situated against the condenser coil 22 on the fan side thereof, as illustrated, e.g., in FIG. 2. As further shown in FIG. 3, the stator row 40 is oblong and rectangular, with a frame 42 that substantially matches the periphery of the fan-facing side of the condenser coil 22. As the fan axis is eccentric with respect to the coil 22, so the fan 24 has a forward projected area which is much smaller than the area of the condenser coil 22. Also, because of this geometry, a vane supporting ring 44 is situated to one side of the center of the frame 42, to be coaxial with the propeller fan 24. A suitable number of stator vanes 46 radiate outward from the ring 44 to the peripheral frame 42. A typical one of these vanes 46 is shown in FIG. 4. The vanes 46 are, preferably, but not necessarily, substantially uniform in width and shape from one end to the other, and are somewhat bowed or arcuate in cross section, as shown in FIG. 5. At the ring 44, the vanes 46 are spaced as close together as possible. The frame 42, ring 44, and vanes 46 are preferably molded unitarily from a plastic synthetic resin. An open area 48 within the ring 44 permits air to flow through it. The fan 24 and stator row 40 are spaced apart a distance that is least few thicknesses of the stator row 40. This permits the air flow from the fan 24 to diffuse somewhat prior to encountering the stator row 40, thus reducing the tangential or swirl component.

The operation and effectiveness of this assembly can be understood from the following discussion, which concerns FIGS. 6–10.

Figure 6:
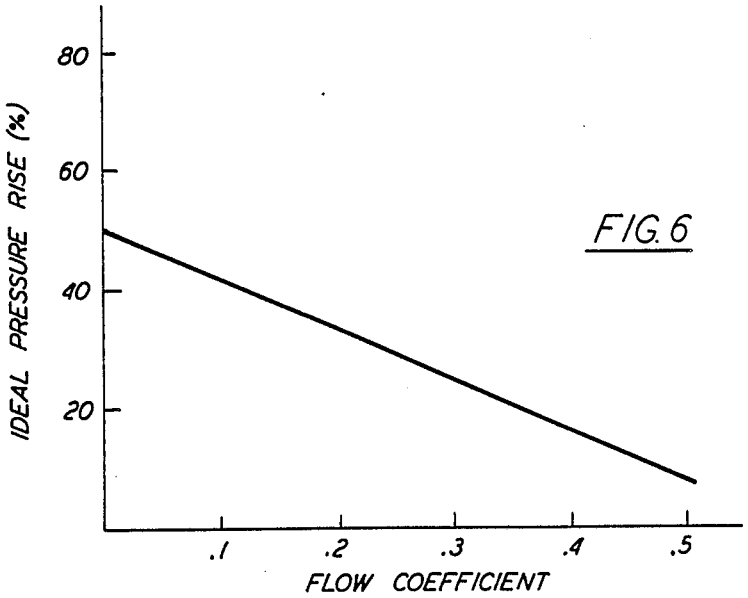
FIG. 6 is a chart relating the ideal gas pressure rise from a frictionless fan attributable to swirl velocity component in a discharge air stream.

For a frictionless or ideal fan with a blade stagger of 150 degrees, the relative amount of pressure rise attributable to the swirl velocity component in the discharge air stream is as generally illustrated in FIG. 6. If the swirl velocity component can be avoided or corrected, an amount up to the percentage shown on the ordinate can be recovered, e.g., in the form of a higher static pressure.

Figure 7:
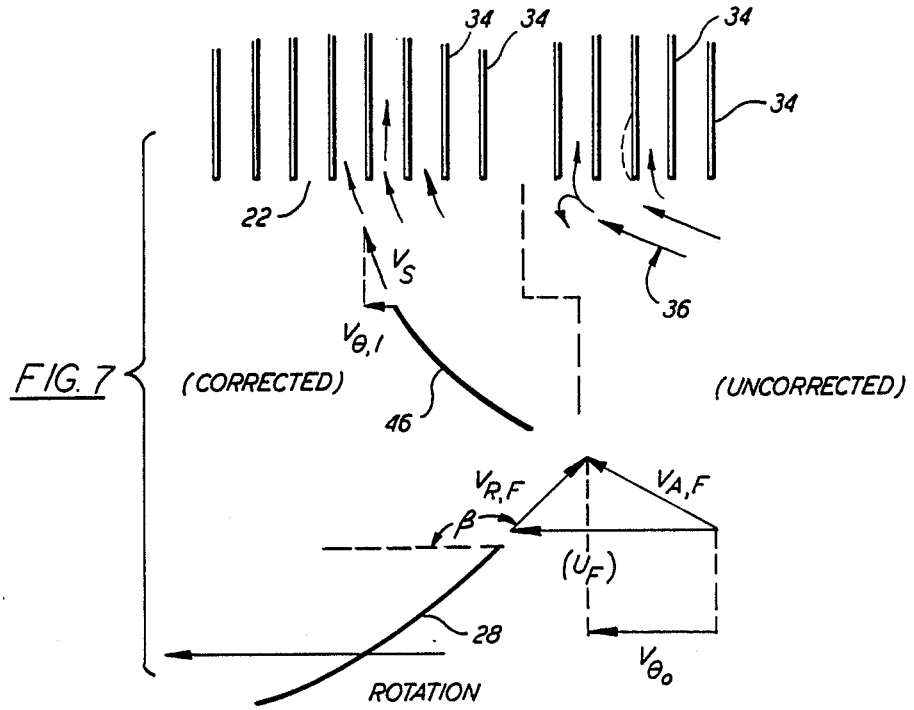
FIG. 7 is a schematic view taken in the radial direction of the fan and stator assembly, showing the effect of the stator assembly on the incidence of air onto the fins of the heat exchanger.

The corrective effect of the stator row 40 can be understood from FIG. 7. Here, for simplicity, a frictionless ideal fan and an ideal stator are assumed. The fan blade 28, as viewed in the fan's radial direction, is moving to the left of the page, and has a fan blade tip velocity vector $U_F$ as illustrated. The forced air discharge velocity vector $V_{RF}$, i.e., the vector with respect to the fan blade, lies along the direction of the trailing edge of the fan blade, as shown, while the absolute fan discharge velocity vector $V_{AF}$, i.e., the vector with respect to the stator row 46, results from algebraically combining the vectors $V_{RF}$ and $U_F$. This velocity vector $V_{AF}$ has a significant tangential component of discharge velocity $V_{\theta O}$. If uncorrected, as illustrated on the right hand side of FIG. 7, the flow velocity vector 36 strikes the condenser coil fins 34 at a large angle, and this results in significant pressure loss. Moreover, $V_{\theta O}$ represents kinetic energy added to the air stream which is ultimately dissipated as heat. Hence, it represents a loss.

With the stator row 40 present, as graphically illustrated on the left side of FIG. 7, the stator vanes 46 change the direction of the airflow velocity vector. Because the pitch of the vanes 46 is complementary to the pitch of the fan blades 28, there is a resulting stator absolute discharge velocity vector $V_S$ as shown. This velocity vector has a relatively small tangential or swirl component $V_{\theta 1}$. The difference between the flow vectors $V_{\theta O}$ and $V_{\theta 1}$ represents a gain in static pressure at the face of the condenser coil 22. Also, as the flow vector $V_S$ is redirected towards the axial direction, the air striking the coil 22 enters more nearly directly along the axial direction, i.e., parallel with the fins 34, thereby significantly reducing turbulence losses at the front face of the coil 22. Hence, the static pressure requirements of the system are reduced as well.

Figure 8:
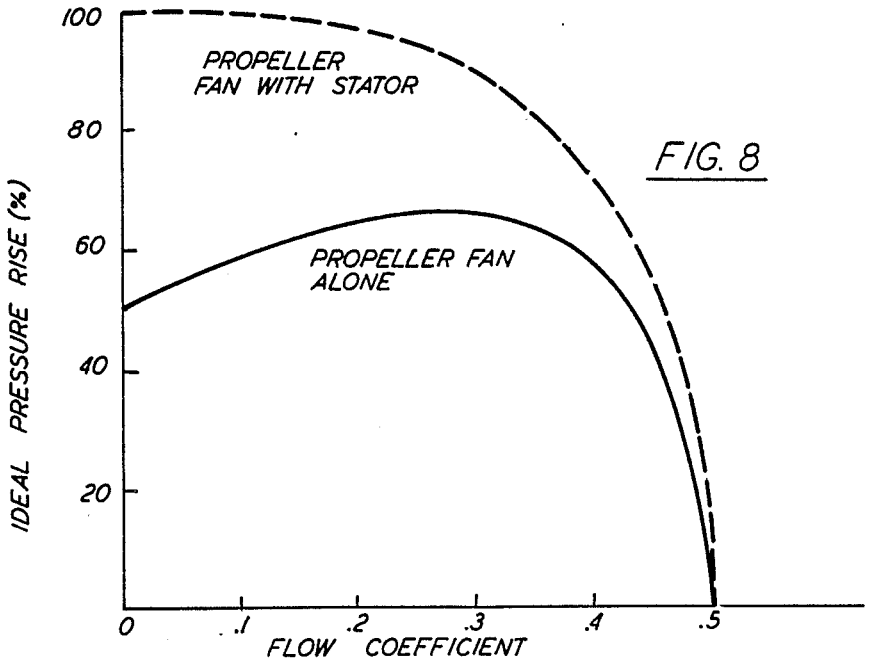
FIG. 8 is a chart which compares the ideal gas pressure rise of a frictionless propeller fan and a propeller fan with stator assembly.

As illustrated in FIG. 8, the stator row 40 can produce a significant static pressure rise when used with the propeller fan (dash-line curve), as compared with the pressure attributable to the propeller fan alone (solid-line curve).

Figure 9:
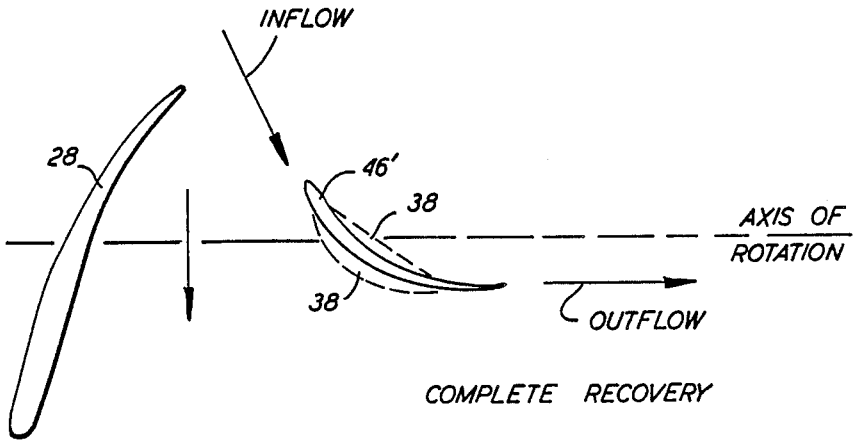
FIGS. 9 and 10 illustrate stator and fan arrangements for full recovery and partial recovery of the swirl component, respectively.

The discussion above has assumed a frictionless, ideal fan and a frictionless, ideal stator. However, losses will be associated with swirl recovery because of viscous effects. As illustrated in FIG. 9, if a rotor vane or blade 46' is selected to effect complete redirection of the flow vector (as illustrated by the inflow and outflow arrows), energy losses will occur because of turbulent areas 38 on the surfaces of the stator blades or vanes 46'. Generally, these losses increase in relation to the degree to which the airflow is straightened. Consequently, maximum benefit from the stator row 40 can occur when the stator discharge or outflow angle is not truly axial, as shown in the partial recovery mode view in FIG. 10.

Figure 10:
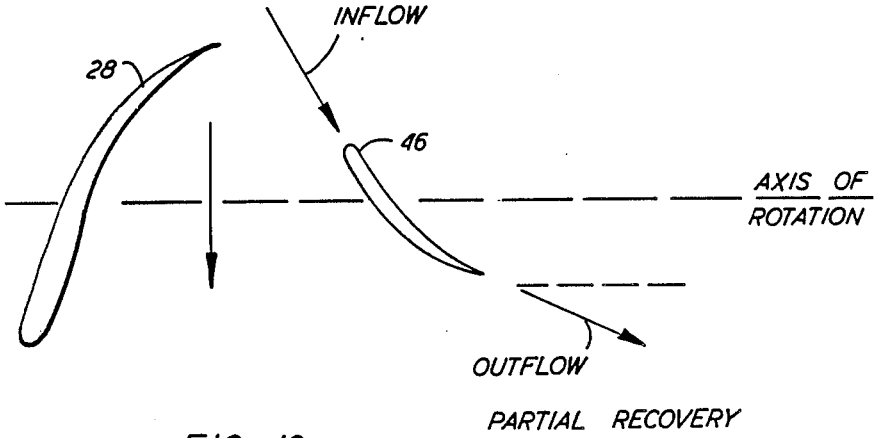

In a practical embodiment, as graphically illustrated in FIG. 10, the stator vane 46 has its geometry selected, relative to that of the fan blade, to achieve maximum net recovery of the swirl component. That is, in a practical embodiment, energy losses contributable to both the swirl component $V_{\theta 1}$ and to turbulence caused by the presence of the stator vane 46, in total, are minimized.

When the stator row 40 incorporating the features described above was incorporated with the outdoor side of a packaged terminal air conditioner unit, a forty percent reduction in shaft power required, and a 3.6 dBA reduction in noise were measured, both directly attributable to the stator row 40.

While this invention was described hereinabove with reference to a single preferred embodiment, it should be understood that many possible modifications and variations could be carried out by those skilled in the art without departing from the scope and spirit of this invention, as defined in the appended claims.

I claim:

1. Heat exchanger and fan assembly comprising:

a heat exchanger coil having a flat, generally rectangular face having a rectangular perimeter and a plurality of fins that define air passages therebetween which pass through the heat exchanger generally perpendicular to said flat face;

an axial flow propeller fan positioned to face said heat exchanger flat face with an axis which passes through the heat exchanger, including a hub, a plurality of blades that radiate from the hub, and drive means for rotating the hub and blades, said blades having a pitch selected to impart a generally axial flow to air when the fan rotates, the flow also having a swirl component in the circumferential direction;

shroud means over said fan and heat exchanger for guiding air into said fan to be forced thereby through the heat exchanger; and a generally rectangular stator of a predetermined thickness mounted against said flat face of said heat exchanger and substantially coextensive therewith, including a plurality of radial blades that extend to the perimeter of the heat exchanger face and have a pitch complementary to that of the fan blades for bending the swirl component of air flow at said heat exchanger face generally toward the axial direction so that the air enters the heat exchanger passages more directly;

and wherein said fan and said stator are spaced apart a distance that is significantly greater than the thickness of the stator, such that the air flow from the fan has an opportunity to diffuse prior to encountering the stator, thus reducing its swirl component at the stator.

2. An air conditioner assembly which comprises an indoor heat exchanger coil that serves as an evaporator, an outdoor heat exchanger coil wherein the outdoor heat exchanger coil is an outdoor condenser coil of said air conditioner assembly, said outdoor heat exchanger coil having a flat face and a plurality of fins that define air passages therebetween which pass through the heat exchanger generally perpendicular to said flat face;

an axial flow propeller fan positioned to face said outdoor heat exchanger flat face with an axis which passes through the heat exchanger, including a hub, a plurality of blades that radiate from the hub, and drive means for rotating the hub and blades, said blades having a pitch selected to impart a generally axial flow of air when the fan rotates, the flow also having a swirl component in the circumferential direction;

shroud means over said fan and outdoor heat exchanger for guiding air into said fan to be forced thereby through the outdoor heat exchanger; and a stator mounted against said flat face of said outdoor heat exchanger and substantially coextensive therewith, including a plurality of radial blades that extend to a perimeter of the outdoor heat exchanger and have a pitch complementary to that of the fan blades for bending the swirl component of air flow at said heat exchanger face generally towards the axial direction so that the air enters the heat exchanger passages more directly;

and wherein said fan and said stator are spaced apart a distance that is significantly greater than the thickness of the stator, such that the air flow from the fan has an opportunity to diffuse prior to encountering the stator, thus reducing its swirl component at the stator.

3. The assembly of claim 2 wherein said air conditioner unit includes an inside fan, and said fan drive means includes means common to said propeller fan and said inside fan for rotating them both.

4. Heat exchanger and fan assembly comprising:

a heat exchanger coil having a flat face with a predetermined perimeter and a plurality of fins that define air passages therebetween which pass through the heat exchanger generally perpendicular to said flat face;

an axial flow propeller fan positioned to face said heat exchanger flat face with an axis which passes through the heat exchanger, including a hub, a plurality of blades that radiate from the hub, and drive means for rotating the hub and blades, said blades having a pitch selected to impart a generally axial flow to air when the fan rotates, the flow also having a swirl component in the circumferential direction;

shroud means over said fan and heat exchanger for guiding air into said fan to be forced thereby through the heat exchanger; and a stator mounted on said flat face of said heat exchanger and substantially coextensive therewith, including a plurality of radial blades that have a pitch complementary to that of the fan blades for bending the swirl component of air flow to said heat exchanger face generally towards the axial direction so that the air enters the heat exchanger passages more directly; in which said stator includes an outer frame coextensive with the perimeter of said flat face and a ring substantially coaxial with said fan, said stator blades extending radially from said ring to said frame; and in which said fan axis is positioned significantly to one side of the center of said heat exchanger flat face and said stator is likewise formed with said ring correspondingly displaced to the same side.

5. The assembly of claim 1 in which said stator frame is a rectangular oblong.

6. The assembly of claim 1 in which said fan has an axially forward projected area that is significantly smaller than the area of said heat exchanger flat face.

7. The assembly of claim 1 in which said stator is unitarily molded of a synthetic resin material.

8. The assembly of claim 1 in which said stator includes an outer frame coextensive with the perimeter of said flat face and a ring substantially coaxial with said fan, said stator blades extending radially from said ring to said frame.

9. The assembly of claim 4 in which said ring is radially coextensive with the fan hub.

* * * * *